US010900331B2

(12) United States Patent
Guo

(10) Patent No.: US 10,900,331 B2
(45) Date of Patent: Jan. 26, 2021

(54) MOVING-RISER METHOD AND SYSTEM FOR HARVESTING NATURAL GAS FROM SEABED HYDRATES

(71) Applicant: University of Louisiana at Lafayette, Lafayette, LA (US)

(72) Inventor: Boyun Guo, Lafayette, LA (US)

(73) Assignee: UNIVERSITY OF LOUISIANA AT LAFAYETTE, Lafayette, LA (US)

( * ) Notice: Subject to any disclaimer, the term of this patent is extended or adjusted under 35 U.S.C. 154(b) by 0 days.

(21) Appl. No.: 16/239,635

(22) Filed: Jan. 4, 2019

(65) Prior Publication Data

US 2019/0211654 A1 Jul. 11, 2019

Related U.S. Application Data

(60) Provisional application No. 62/613,882, filed on Jan. 5, 2018.

(51) Int. Cl.

| | |
|---|---|
| ***E21B 17/01*** | (2006.01) |
| ***E21B 19/00*** | (2006.01) |
| ***E21B 43/01*** | (2006.01) |
| ***E21B 43/24*** | (2006.01) |
| ***E21B 43/40*** | (2006.01) |
| ***B63B 35/44*** | (2006.01) |
| ***E21C 50/00*** | (2006.01) |
| ***E02F 3/88*** | (2006.01) |
| ***E21B 17/00*** | (2006.01) |
| *E21B 41/00* | (2006.01) |

(52) U.S. Cl.

CPC ..... *E21B 43/0107* (2013.01); *B63B 35/4413* (2013.01); *E02F 3/88* (2013.01); *E21B 17/003* (2013.01); *E21B 17/01* (2013.01); *E21B 19/002* (2013.01); *E21B 43/24* (2013.01); *E21B 43/40* (2013.01); *E21C 50/00* (2013.01); *B63B 2035/448* (2013.01); *E21B 41/0099* (2020.05)

(58) Field of Classification Search

CPC ..... E21B 17/003; E21B 17/01; E21B 19/002; E21B 43/0107; E21B 43/24; E21B 43/36; E21B 43/40; E21B 2043/0115; E21B 41/0099; B63B 35/4413; E21C 50/00; E02F 3/88

See application file for complete search history.

(56) References Cited

U.S. PATENT DOCUMENTS 5,950,732 A * 9/1999 Agee ..... C10G 2/30 166/354
6,817,427 B2 * 11/2004 Matsuo ..... E21B 43/166 175/67

(Continued)

*Primary Examiner* — Matthew R Buck
(74) *Attorney, Agent, or Firm* — Russel O. Primeaux; Lauren J. Rucinski; Kean Miller LLP

(57) ABSTRACT

A method and equipment for harvesting natural gas from seabed hydrates are disclosed. The preferred equipment includes a mobile riser, a water injection nozzle, a gas collector, a gas separator, a gas compressor, a water pump, and a water boiler. A fraction of produced gas is used to heat water which is in turn injected to seafloor for dissociating gas hydrates. The preferred method of the invention comprises producing natural gas from seabed hydrates using a production ship with a moving riser installed. This method eliminates the need of drilling wells and thus cuts cost of gas production tremendously.

9 Claims, 2 Drawing Sheets

(56) References Cited

U.S. PATENT DOCUMENTS

| | | | | |
|---|---|---|---|---|
| 7,546,880 | B2 * | 6/2009 | Zhang | E21B 43/0122 166/302 |
| 8,522,881 | B2 * | 9/2013 | Worrall | E21B 37/06 166/304 |
| 2003/0178195 | A1 * | 9/2003 | Agee | E21B 43/24 166/248 |
| 2012/0181041 | A1 * | 7/2012 | Willman | E02F 3/925 166/357 |
| 2012/0193103 | A1 * | 8/2012 | Hall | E21C 50/00 166/344 |
| 2013/0074757 | A1 * | 3/2013 | McAlister | B01J 7/00 114/264 |

* cited by examiner

MOVING-RISER METHOD AND SYSTEM FOR HARVESTING NATURAL GAS FROM SEABED HYDRATES

CROSS REFERENCE TO RELATED APPLICATIONS

This application claims priority to a U.S. provisional patent application No. 62/613,882 filed Jan. 5, 2018 and entitled "MOVING-RISER METHOD AND SYSTEM FOR HARVESTING NATURAL GAS FROM SEABED HYDRATES."

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

DESCRIPTION OF THE DRAWINGS

The drawings constitute a part of this specification and include exemplary embodiments of the MOVING-RISER METHOD AND SYSTEM FOR HARVESTING NATURAL GAS FROM SEABED HYDRATES, which may be embodied in various forms. It is to be understood that in some instances, various aspects of the invention may be shown exaggerated or enlarged to facilitate an understanding of the invention. Therefore the drawings may not be to scale.

BACKGROUND

Figure 1:
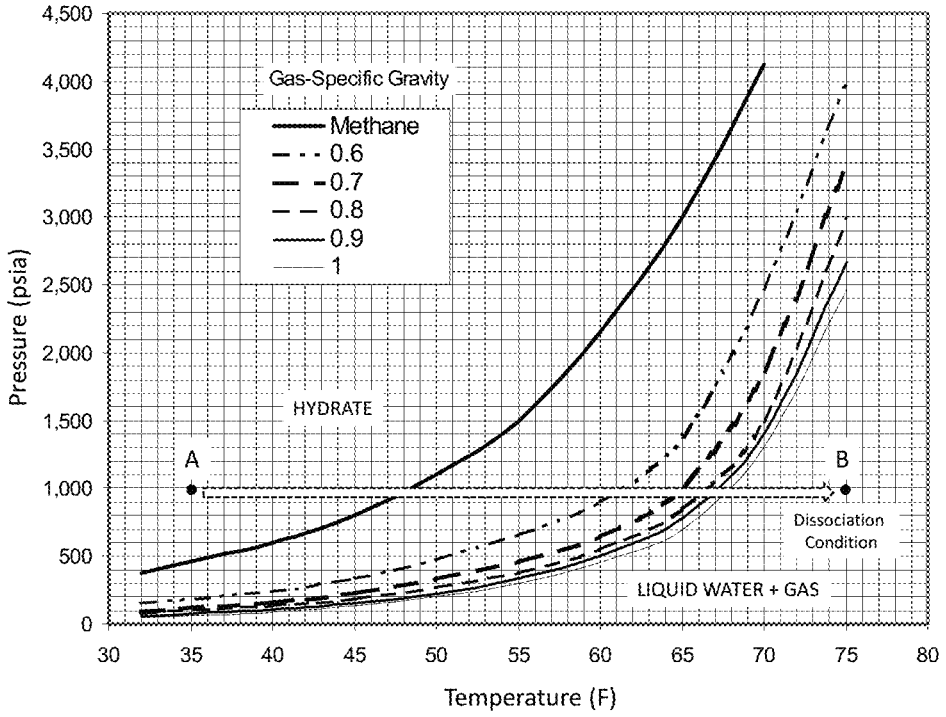
FIG. 1 is a simplified phase diagram comprising hydrate-water-gas.

Natural gas hydrates are ice-like structures in which gas, most often methane gas, is trapped inside of water molecules. Unlike ice, gas hydrates are highly flammable, a property that makes these crystalline structures an attractive future energy source.

Hydrates provide an abundant source of natural gas, relative to conventional deposits. According to the U.S. Geological Survey, global stocks of gas hydrates range account for at least 10 times the supply of conventional natural gas deposits, with between 100,000 and 300,000,000 trillion cubic feet of gas yet to be discovered. If these sources of natural gas could be safely, efficiently and cost effectively tapped into, gas hydrates could potentially displace coal and oil as the top sources of the world's energy.

Although gas hydrates can be found in permafrost, the majority of the supply of gas hydrates can be found thousands of feet—at least 1,600 feet—below the sea's surface where the gas molecules crystallize amidst the cold ocean depths.

Like any other fossil fuel, gas hydrates are hydrocarbon chains composed of carbon and hydrogen. Gas hydrates hold twice as much carbon as Earth's other fossil fuels combined.

The nominal methane gas clathrate hydrate composition is $(CH_4)_4(H_2O)_{23}$, or 1 mole of gas for every 5.75 moles of water, corresponding to 13.4% gas by mass. But, the actual composition is dependent on how many gas molecules fit into the various cage structures of the water lattice. The observed density is approximately 0.9 g/cm$^3$, which is less than water. Meaning, gas hydrate will float to the surface of the sea unless it is bound in place by being formed in or anchored to sediment. One liter of fully saturated gas clathrate solid contains approximately 120 grams of gas (or around 169 liters of gas at 0° C. and 1 atm), Said another way, one cubic meter of gas clathrate releases about 160 cubic meters of gas.

Gas clathrates in continental rocks are trapped in beds of sandstone or siltstone at depths of less than 800 meters. They are formed from a mix of thermally and microbially derived gas from which the heavier hydrocarbons were later selectively removed. These occur in Alaska, Siberia, and Northern Canada.

The four methods for gas production from Nature Gas Hydrate (NGH) deposits are: 1) depressurization seeks to decrease the pressure in NGH deposit below the hydrate dissociation pressure; 2) thermal stimulation uses external heat to make the temperature in the NGH deposit above hydrate dissociation temperature with hot water, brine, and/or steam; 3) thermodynamic inhibitor injection is designed to inject chemicals, such as salts and alcohols, to change the hydrate pressure—temperature equilibrium conditions; and 4) some combination of these methods.

While some have studied or had limited success in production of natural gas from hydrates, the industry consensus is that commercial-scale production remains years away due to unsolved technical and environmental issues. Wellbore collapse and sand production, among other issues, have hindered production of natural gas from seabed hydrates for the past two decades. Thus, a new method is needed that will address the cost, technical, and environmental limitations of harvesting natural gas from seabed hydrates.

The invention provides a low cost means of harvesting natural gas from seabed gas hydrates. It eliminates drilling expensive and troublesome wells. The invention also does not require reducing pressure in the hydrate deposits. This avoids environmental consequences. Additionally, the invention adapts to gas hydrate deposits in relatively far distances from shoreline where it is extremely costly to build pipelines for gas transportation.

A primary object of the invention is the economical generation of hot water using a fraction of gas produced from seabed gas hydrates. Another object of the invention is the efficient transport of the hot water containing hydrate inhibitors to the seabed using a flexible insulated moving riser. Still another object of the invention is the safe collection of natural gas released from the seabed gas hydrates using a funnel-shaped device. And another object of the invention is the efficient transport of the collected gas to the ship using the same flexible insulated moving riser.

DETAILED DESCRIPTION

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies. Although the terms "step" might be used herein to connote different components of methods or systems employed, the terms should not be interpreted as implying any particular order among or between various steps herein disclosed unless and except when the order of individual steps is explicitly described.

Furthermore, the described features, structures, or characteristics may be combined in any suitable manner in one or more embodiments. In the following description, numerous specific details are provided, such as examples of materials, hoses, and hydrate inhibitors. One skilled in the relevant art will recognize, however, that MOVING-RISER METHOD AND SYSTEM FOR HARVESTING NATURAL GAS FROM SEABED HYDRATES may be practiced without one or more of the specific details, or with other methods, components, materials, and so forth. In other instances, well-known structures, materials, or operations are not shown or described in detail to avoid obscuring aspects of the invention.

The invention relates to a method of harvesting natural gas from seafloor gas hydrates and equipment therefor. An exemplary embodiment comprises injecting hot water with hydrate inhibitors through an inner pipe of an insulated moving riser and a nozzle to the surface of hydrates from a vessel, collecting the dissociated gas, guiding the gas through the annulus of the moving riser, separating the gas from water, compressing the gas for sale, and combusting a portion of the produced gas to generate hot water for the injection.

FIG. 1 is a simplified phase diagram of the preferred method of the invention invoking dissociation of gas hydrates. Equilibrium curves are based on data from public domain. Dissociation of gas hydrates from solid hydrate to liquid water and gas is affected by the increased temperature under isobar conditions. The dissociation temperature and pressure are indicated at point B.

Figure 2:
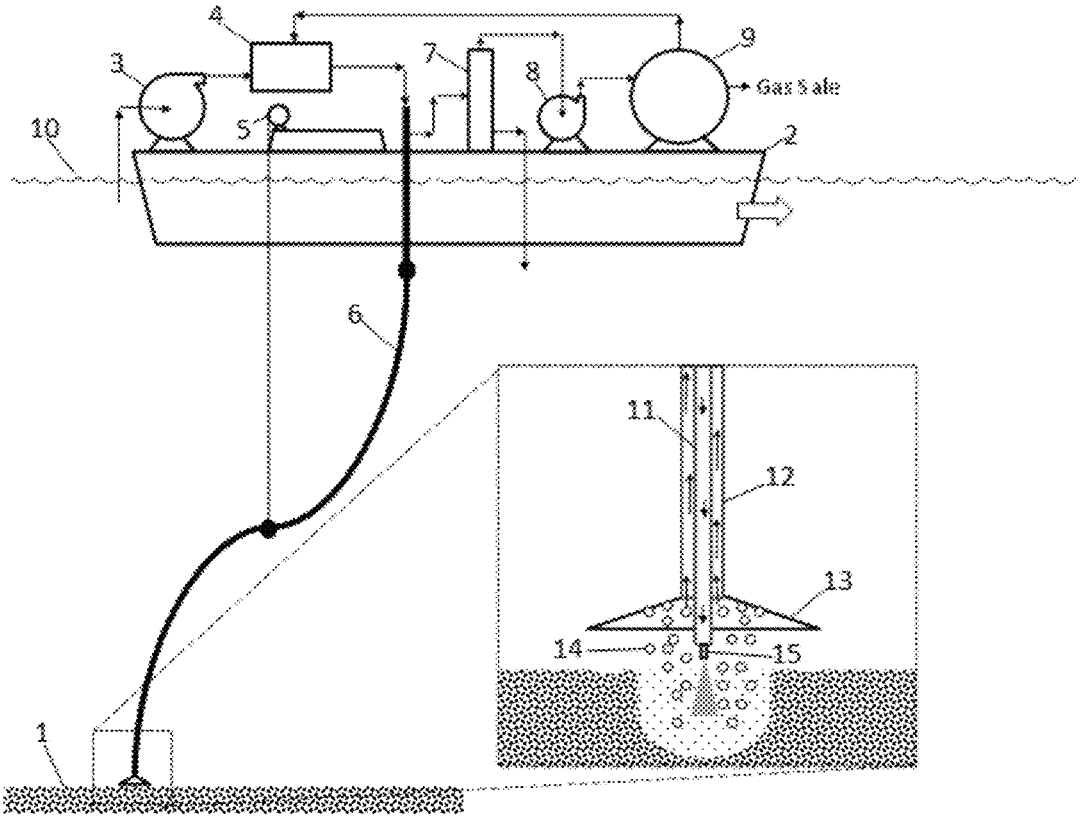
FIG. 2 is a schematic diagram of a preferred system of the invention.

FIG. 2 depicts an exemplary embodiment of the invention. According to FIG. 2, natural gas is harvested from gas hydrates located on the seafloor 1 using system equipment installed on a gas production ship 2. In other embodiments, other types of vessels may be used so long as the system can be transported onsite. The system may also be located on an offshore platform or some other semi-permanent structure.

According to FIG. 2, seawater at sea level 10 is gathered by a submersible pump. The seawater is then transferred by a first pump 3 and suitable conduit to a water heater 4. The water heater 4 heats the seawater to the desired temperature of 75 to 95 degrees (centigrade). In one embodiment, the water heater operates by combustion of a fraction of the natural gas harvested from the seafloor 1. However, the water heater 4 may operate by combustion of purchased, previously-produced, or simultaneously harvested natural gas or some combination thereof.

Once the seawater is heated, hydrate inhibitors are injected by a small pump to the hot water. Any hydrate inhibitor as known in the art may be used, for example: methanol, ethylene glycol, diethylene glycol, triethylene glycol, tetraethylene glycol, or some combination thereof. Then, the hot water containing hydrate inhibitors is injected down to the seafloor 1 through an inner pipe of a hose assembly 6. The hose assembly is held by a hoister 5 for depth adjustment. The inner pipe 11 of the hose assembly 6 has a nozzle 15 installed. The nozzle 15 funnels expelled stream to create a water jet. The waterjet stream of hot water and hydrate decomposes the hydrates to release natural gas 14. The released natural gas 14 is collected by a gas collector 13. The gas collector 13 then guides the released natural gas 14 to the riser 12 of the hose assembly 6. The gas collector is suitably cone or funnel-shaped to corral all of the released gas. However, other shapes may be used. The gas collector 13 may be made of any suitable material, including corrosive resistant metal.

The gas collector 13 then guides the released natural gas 14 to the riser 12 of the hose assembly 6. The collected, buoyant gas moves up the riser 12 because of the low pressure created by the relatively low density of the water-gas mixture in the riser. The hydrate inhibitors in the water prevent hydrates from re-reforming under the gas collector 13 and in the riser 12.

Upon arriving at the gas production ship 2 the produced gas-water mixture is separated by a separator 7 as known in the art. The water phase is directed back to the sea via a conduit and the produced gas phase is directed to the compressor 8 by a separate conduit. Once compressed, the natural gas is released through another conduit to a gas tank 9. A portion of the gas in the tank 9 is routed to the water heater to use as feedstock and the remaining gas is stored before it can be sold. The gas production ship 2 may move slowly to harvest gas continuously.

For the purpose of understanding the MOVING-RISER METHOD AND SYSTEM FOR HARVESTING NATURAL GAS FROM SEABED HYDRATES, references are made in the text to exemplary embodiments of an MOVING-RISER METHOD AND SYSTEM FOR HARVESTING NATURAL GAS FROM SEABED HYDRATES, only some of which are described herein. It should be understood that no limitation on the scope of the invention is intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Reference throughout this specification to features, advantages, or similar language does not imply that all of the features and advantages that may be realized should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the MOVING-RISER METHOD AND SYSTEM FOR HARVESTING NATURAL GAS FROM SEABED HYDRATES may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

The invention claimed is:

1. A method for harvesting natural gas from seabed gas hydrates comprising:

a. delivering water through a hose assembly from a vessel to a seafloor, wherein said water is heated by a water heater before being delivered through said hose assembly;

b. injecting said heated water through said hose assembly to at least one gas hydrate located on said seafloor so that gas is released from said at least one hydrate;

c. collecting said gas released from said at least one gas hydrate;

d. transporting said collected gas from the seafloor to the vessel through said hose assembly; and e. routing at least a portion of said collected gas through a separator and on to a compressor and then to said water heater as feedstock.

2. The method of claim 1 wherein said collecting step is performed by a collector installed at the bottom of said hose assembly.

3. The method of claim 1 wherein said vessel is a production ship.

4. The methods of claim 1 wherein said hose assembly comprises an insulated inner pipe and an insulated riser.

5. The method of claim 1 wherein said collecting step is performed by a funnel-shaped gas collector.

6. The method of claim 1 wherein said hose assembly is a two-phase flow through annulus.

7. A system for harvesting natural gas from seabed gas hydrates comprising:

a. a conduit with a submersible pump in connection with the sea at one end and with a water injection pump at the other end, so that said conduit transfers seawater to said water injection pump;

b. a hot water heater in connection with said water injection pump wherein said water injection pump transfers said seawater to said hot water heater;

c. a hose assembly in connection with said hot water heater and a seafloor wherein said hose assembly comprises a seawater injector and a gas intake at the seafloor end and an outtake on the other end;

d. a liquid gas separator in connection with said hose assembly outtake, said liquid gas separator comprising a water phase outtake and a gaseous phase outtake;

e. a compressor in connection with said liquid gas separator gaseous phase outtake;

f. a gas holding tank in connection with said compressor; and g. a second conduit from said gas holding tank to said hot water heater so that at least a portion of said harvested natural gas is feedstock for said hot water heater.

8. The system of claim 7 wherein said hose assembly comprises an insulated inner pipe and an insulated riser.

9. The system of claim 8 wherein said gas intake comprises a funnel-shaped gas collector.

* * * * *